US008746296B2

(12) United States Patent
Tobbe et al.

(10) Patent No.: US 8,746,296 B2
(45) Date of Patent: Jun. 10, 2014

(54) REFRIGERATOR APPLIANCE WITH FEATURES FOR ASSISTED DISPENSING

(75) Inventors: Joseph Anthony Tobbe, Louisville, KY (US); Jeffrey Martin Wood, Louisville, KY (US); Michael Thomas Chezem, Georgetown, IN (US); Juan David Payares, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/477,486

(22) Filed: May 22, 2012

(65) Prior Publication Data

US 2013/0312872 A1 Nov. 28, 2013

(51) Int. Cl.

| | |
|---|---|
| ***B65B 1/30*** | (2006.01) |
| ***F25B 49/00*** | (2006.01) |
| ***B67D 1/12*** | (2006.01) |

(52) U.S. Cl.

CPC ..... *B67D 1/1236* (2013.01)
USPC ..... 141/94; 141/95; 141/198; 141/351; 62/389; 62/125; 62/126

(58) Field of Classification Search

CPC ..... F25D 23/126; F25D 2400/36; F25D 2400/361; F25C 5/005; B67D 1/124; B67D 1/1236; B67D 1/1238
USPC ..... 141/94, 95, 192, 198, 351, 360; 62/389, 62/126

See application file for complete search history.

(56) References Cited

U.S. PATENT DOCUMENTS

| | | | | |
|---|---|---|---|---|
| 3,429,140 | A | 2/1969 | White | |
| 3,624,832 | A | 11/1971 | Dunn | |
| 3,830,406 | A | 8/1974 | Robb | |
| 3,908,394 | A | 9/1975 | Jacobus | |
| 4,370,865 | A | 2/1983 | Hibino et al. | |
| 4,448,032 | A | 5/1984 | Hibino et al. | |
| 4,456,149 | A | 6/1984 | Sciortino | |
| 4,658,872 | A | 4/1987 | Ellis | |
| 4,912,942 | A | 4/1990 | Katterhenry et al. | |
| 5,085,810 | A | 2/1992 | Burrows | |
| 5,148,842 | A | 9/1992 | Boust | |
| 5,230,448 | A | 7/1993 | Strohmeyer et al. | |
| 5,390,714 | A | 2/1995 | North, III et al. | |
| 5,405,052 | A | 4/1995 | Sawyer, III | |
| 5,491,333 | A * | 2/1996 | Skell et al. | 250/222.1 |
| 5,553,744 | A | 9/1996 | Sawyer, III | |
| 6,138,387 | A | 10/2000 | Fox et al. | |
| 6,651,449 | B2 | 11/2003 | Heims et al. | |
| 7,028,725 | B2 * | 4/2006 | Hooker | 141/141 |
| 7,032,780 | B2 | 4/2006 | Crisp, III | |
| 7,040,110 | B2 | 5/2006 | Nowak | |
| 7,124,521 | B1 | 10/2006 | Medoro | |
| 7,673,661 | B2 | 3/2010 | Chase et al. | |
| 7,712,328 | B2 | 5/2010 | Harris | |
| 7,836,709 | B2 * | 11/2010 | An et al. | 62/126 |
| 7,950,424 | B2 * | 5/2011 | Ozanne et al. | 141/198 |
| 8,028,728 | B2 * | 10/2011 | Cooper | 141/351 |

(Continued)

*Primary Examiner* — Timothy L Maust
*Assistant Examiner* — Robert Bell, III
(74) *Attorney, Agent, or Firm* — Dority & Manning PA

(57) ABSTRACT

A refrigerator appliance is provided with a dispenser for directing a flow of ice and/or water to a dispenser recess of the dispenser. A camera is directed towards the dispenser recess, and a display is also provided for displaying an image from the camera. The image can assist a user in positioning a container within the dispenser recess.

20 Claims, 4 Drawing Sheets

(56) References Cited

U.S. PATENT DOCUMENTS

| | | | | |
|---|---|---|---|---|
| 8,040,666 | B2 * | 10/2011 | McCoy et al. | 361/679.01 |
| 8,109,301 | B1 * | 2/2012 | Denise | 141/360 |
| 8,322,384 | B2 * | 12/2012 | Ashrafzadeh et al. | 141/198 |
| 8,327,889 | B2 * | 12/2012 | Ashrafzadeh et al. | 141/94 |
| 8,443,614 | B2 * | 5/2013 | Kim | 62/3.64 |
| 2006/0096303 | A1 * | 5/2006 | Kavounas | 62/125 |
| 2007/0267098 | A1 * | 11/2007 | Ozanne et al. | 141/198 |
| 2008/0264092 | A1 * | 10/2008 | Chase et al. | 62/389 |
| 2010/0155415 | A1 | 6/2010 | Ashrafzadeh et al. | |
| 2011/0048056 | A1 | 3/2011 | Ashrafzadeh et al. | |
| 2011/0214441 | A1 | 9/2011 | Ashrafzadeh et al. | |
| 2012/0104023 | A1 * | 5/2012 | Anselmino et al. | 222/1 |
| 2012/0138629 | A1 * | 6/2012 | Ashrafzadeh et al. | 222/1 |
| 2012/0260683 | A1 * | 10/2012 | Cheon et al. | 62/125 |

* cited by examiner

FIG. —1—

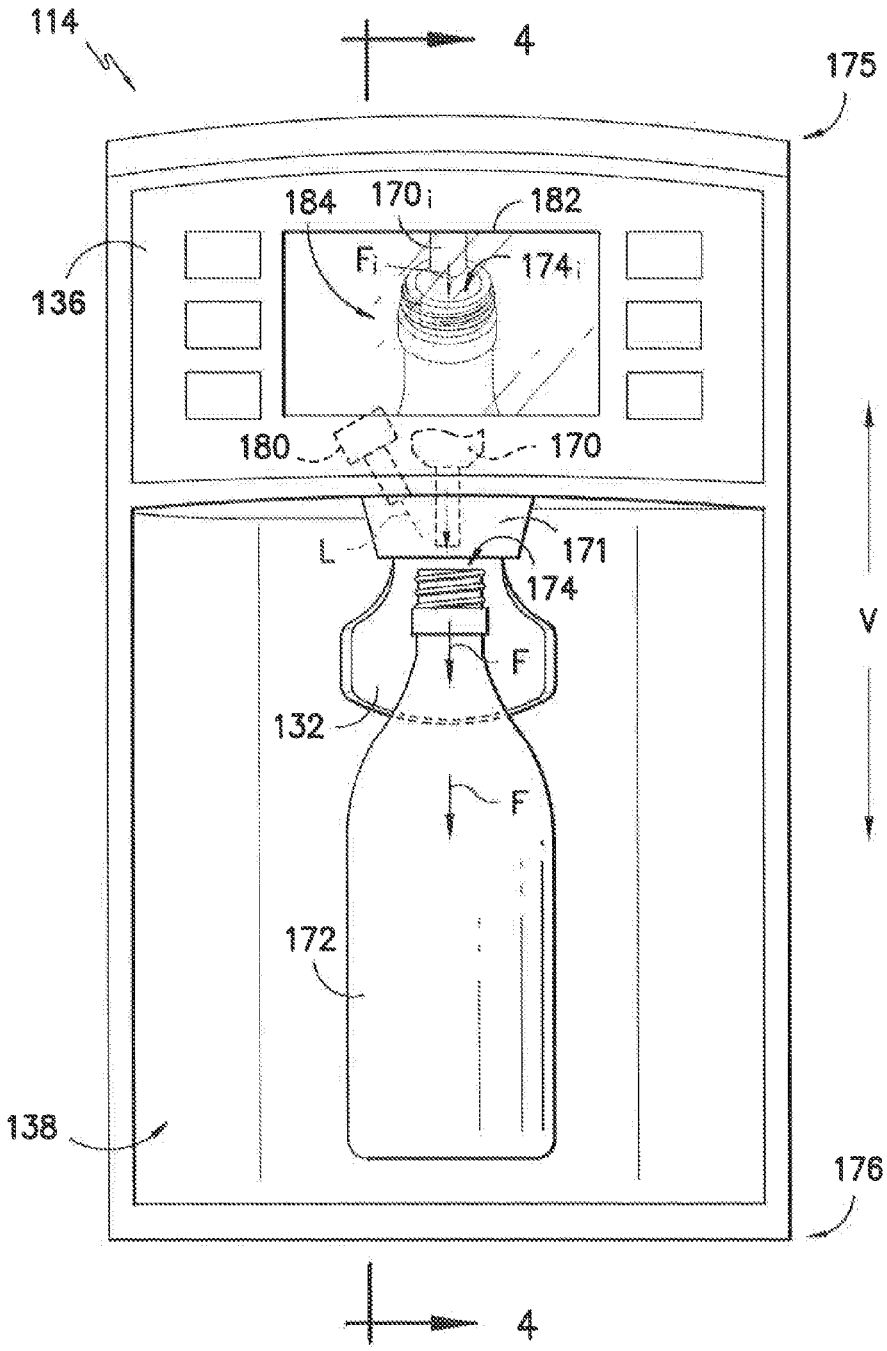
FIG. —3—

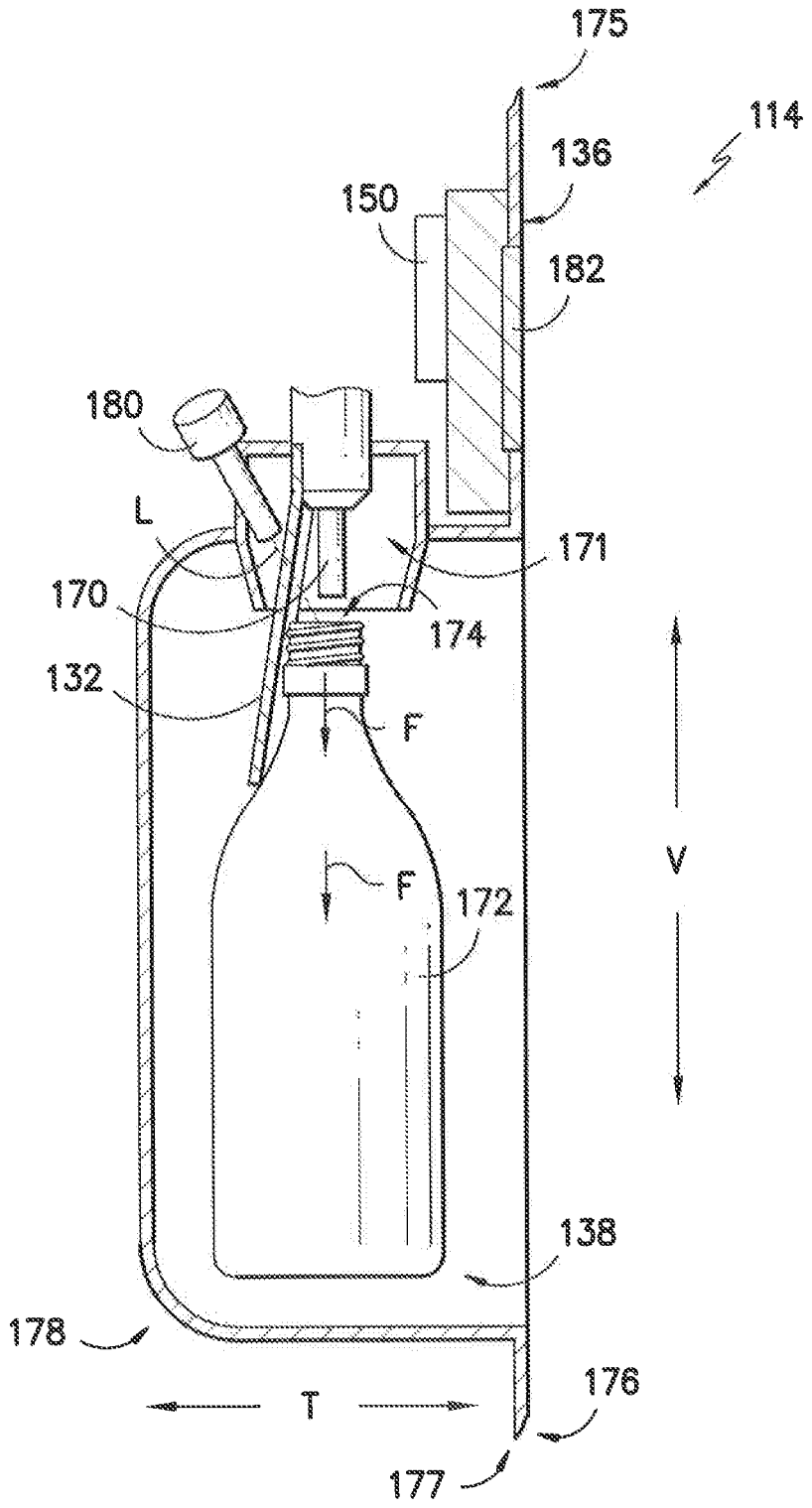
FIG. —4—

REFRIGERATOR APPLIANCE WITH FEATURES FOR ASSISTED DISPENSING

FIELD OF THE INVENTION

The present subject matter relates generally to refrigerator appliances with features for assisted dispensing, e.g., of ice and/or water.

BACKGROUND OF THE INVENTION

Refrigerator appliances generally include a cabinet that defines a chilled chamber for receipt of food items for storage. Refrigerator appliances can also include features for dispensing ice and/or water. To dispense ice and water, certain refrigerator appliances include a dispenser mounted to a door of the appliance. The dispenser can direct ice from an ice maker within the refrigerator appliance to an ice dispensing outlet within the dispenser. Similarly, the dispenser can direct water from a water supply to a water dispensing outlet within the dispenser.

As an example, a user can insert a container into the dispenser and initiate a flow of ice and/or water into the container. In particular, certain refrigerator appliances include a paddle mounted within a dispenser recess. The user can push the container against the paddle in order to initiate the flow of ice and/or water into the container.

However, filling certain containers with ice and/or water from the dispenser can be troublesome. For example, certain water bottles have relatively small openings. Directing a flow of water from the water dispensing outlet into the bottle's small opening can be difficult because the user's view of the opening is often obstructed. For example, the dispenser is often located at about a chest height of the user. In addition, the dispenser's paddle and water dispensing outlet are often located at a back of the dispenser such that the user cannot see the paddle or water dispensing outlet without stooping over.

Accordingly, a refrigerator appliance with features for assisting a user with filling a container with ice and/or water would be useful. In particular, a refrigerator appliance with features for assisting a user with filling containers with small openings would be useful. Further, a refrigerator appliance with features for assisting a user to easily and accurately direct a flow of water and/or ice into a container would be useful.

BRIEF DESCRIPTION OF THE INVENTION

The present subject matter provides a refrigerator appliance with a dispenser for directing a flow of ice and/or water to a dispenser recess of the dispenser. A camera is directed towards the dispenser recess, and a display is also provided for displaying an image from the camera. The image can assist a user in positioning a container within the dispenser recess. Additional aspects and advantages of the invention will be set forth in part in the following description, or may be apparent from the description, or may be learned through practice of the invention.

In a first exemplary embodiment, a refrigerator appliance is provided. The refrigerator appliance includes a cabinet that defines a chilled chamber for receipt of food articles. A door is mounted to the cabinet. The door is configured for permitting selective access to the chilled chamber of the cabinet. A dispenser is mounted to the door. The dispenser defines a dispensing recess. A camera is directed towards the dispensing recess of the dispenser. A display is in communication with the camera. The display is configured for displaying an image of the dispenser recess from the camera.

In a second exemplary embodiment, a refrigerator appliance is provided. The refrigerator appliance includes a cabinet that defines a chilled chamber configured for receipt of food items. A door is mounted to the cabinet and configured for permitting selective access to the chilled chamber of the cabinet. A dispenser for directing a flow of ice or water into a dispenser recess defined by the dispenser is mounted to the door. A camera is mounted to the door and pointed towards the dispenser recess of the dispenser. A display is also mounted to the door. The display is configured for displaying an image of the dispenser recess from the camera.

In a third exemplary embodiment, a refrigerator appliance is provided. The refrigerator appliance includes a cabinet that defines a chilled chamber for receipt of food articles. A door is mounted to the cabinet. The door is configured for permitting selective access to the chilled chamber of the cabinet. A dispenser is mounted to the door. The dispenser defines a dispensing recess. A means for assisting a user in aligning a container with an outlet of the dispenser is also provided.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 3 is a front view of a dispenser of the refrigerator appliance of FIG. 1 and, in particular, illustrates the dispenser directing a flow of water into a container positioned within a dispenser recess of the dispenser.

FIG. 4 illustrates a cross-sectional view of the dispenser of FIG. 3 taken along the 4-4 line of FIG. 3.

DETAILED DESCRIPTION

Figure 1:
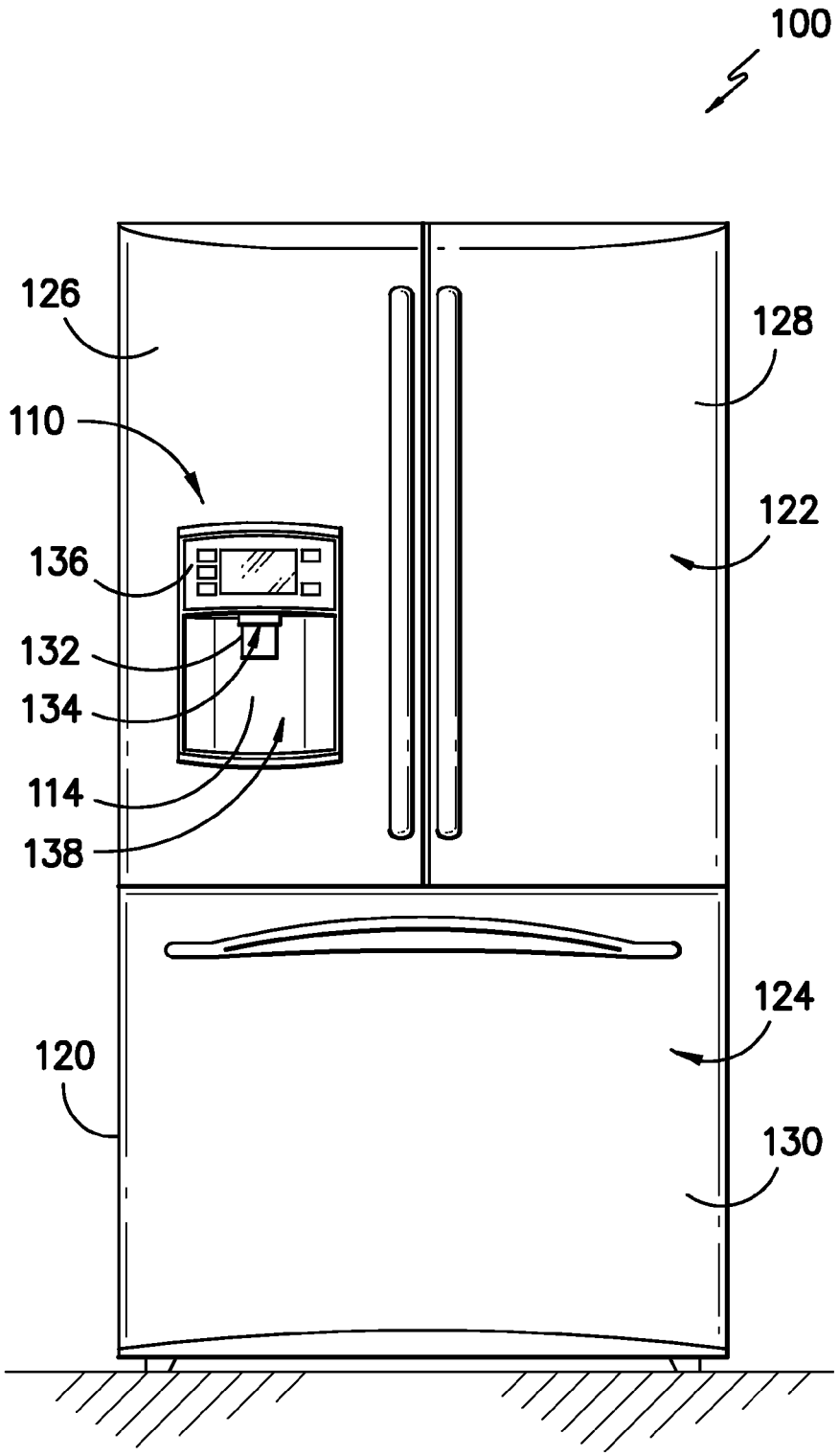
FIG. 1 provides a front view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a front view of an exemplary embodiment of a refrigerator appliance 100. Refrigerator appliance 100 includes a cabinet or housing 120 defining an upper fresh food chamber 122 and a lower freezer chamber 124 arranged below the fresh food chamber 122. As such, refrigerator appliance 100 is generally referred to as a bottom mount refrigerator. In the exemplary embodiment, housing 120 also defines a mechanical compartment (not shown) for receipt of a sealed cooling system. Using the teachings disclosed herein, one of skill in the art will understand that the present invention can be used with other types of refrigerators (e.g., side-by-sides). Consequently, the description set forth herein is for illustrative purposes only and is not intended to limit the invention in any aspect.

Refrigerator doors 126, 128 are rotatably hinged to an edge of housing 120 for accessing fresh food compartment 122. A freezer door 130 is arranged below refrigerator doors 126, 128 for accessing freezer chamber 124. In the exemplary embodiment, freezer door 130 is coupled to a freezer drawer (not shown) slidably mounted within freezer chamber 124.

Refrigerator appliance 100 includes a dispensing assembly 110 for dispensing water and/or ice. Dispensing assembly 110 includes a dispenser 114 positioned on an exterior portion of refrigerator appliance 100. Dispenser 114 includes a discharging outlet 134 for accessing ice and water. An activation member 132 is mounted below discharging outlet 134 for operating dispenser 114. In FIG. 1, activation member 132 is shown as a paddle. However, activation member 132 may be any other suitable mechanism for signaling or indication initiating a flow of ice and/or water into a container within dispenser 114, e.g., a switch or button. A user interface panel 136 is provided for controlling the mode of operation. For example, user interface panel 136 includes a water dispensing button (not labeled) and an ice-dispensing button (not labeled) for selecting a desired mode of operation such as crushed or non-crushed ice.

Discharging outlet 134 and activation member 132 are an external part of dispenser 114, and are mounted in a recessed portion 138 defined in an outside surface of refrigerator door 126. Recessed portion 138 is positioned at a predetermined elevation convenient for a user to access ice or water and enabling the user to access ice without the need to bend-over and without the need to access freezer chamber 124. In the exemplary embodiment, recessed portion 138 is positioned at a level that approximates the chest level of a user.

Figure 2:
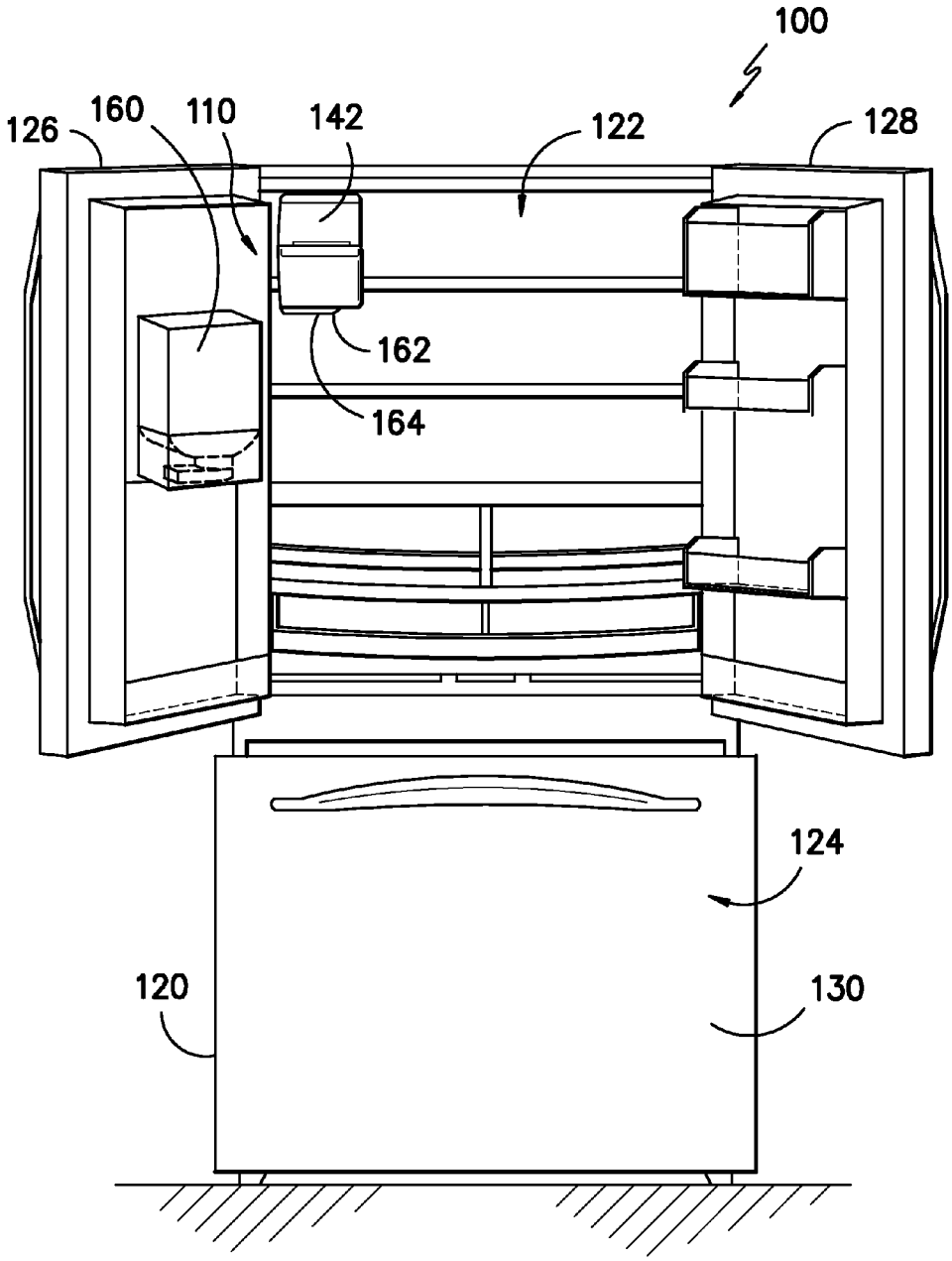
FIG. 2 provides a front view of the refrigerator appliance of FIG. 1 with refrigerator doors of the refrigerator appliance shown in an open configuration to reveal a fresh food chamber of the refrigerator appliance.

FIG. 2 is a perspective view of refrigerator appliance 100 having refrigerator doors 126, 128 in an open position to reveal the interior of the fresh food chamber 122. As such, certain components of dispensing assembly 110 are illustrated. Dispensing assembly 110 includes an insulated housing 142 mounted within refrigerator chamber 122. Due to insulation surrounding insulated housing 142, the temperature within insulated housing 142 can be maintained at levels different from the ambient temperature in the surrounding fresh food chamber 122.

In particular, insulated cavity 142 is constructed and arranged to operate at a temperature that facilitates producing and storing ice. More particularly, the insulated cavity contains an ice maker for creating ice and feeding the same to a receptacle 160 that is mounted on refrigerator door 126. As illustrated in FIG. 2, receptacle 160 is placed at a vertical position on refrigerator door 126 that will allow for the receipt of ice from a discharge opening 162 located along a bottom edge 164 of insulated housing 142 when refrigerator door 126 is in a closed position (shown in FIG. 1). As door 126 is closed or opened, receptacle 160 is moved in and out of position under insulated housing 142.

Alternatively, in another exemplary embodiment of the present invention, insulated housing 142 and its ice maker can be positioned directly on door 126. In still another exemplary embodiment of the present invention, in a configuration where the fresh food compartment and the freezer compartment are located side by side (as opposed to over and under as shown in FIGS. 1 and 2), the ice maker could be located on the door for the freezer compartment and directly over receptacle 160. As such, the use of an insulated housing would be unnecessary. Other configurations for the location of receptacle 160, an ice maker, and/or insulated housing 142 may be used as well.

Operation of the refrigerator appliance 100 is regulated by a controller 150 (FIG. 4) that is operatively coupled to user interface panel 136 and/or activation member 132 (shown in FIG. 1). Panel 136 provides selections for user manipulation of the operation of refrigerator appliance 100 such as e.g., selections between whole or crushed ice, chilled water, and/or other options as well. In response to user manipulation of the user interface panel 136, controller 150 operates various components of the refrigerator appliance 100. Controller 150 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor.

Controller 150 may be positioned in a variety of locations throughout refrigerator appliance 100. In the illustrated embodiment shown in FIG. 4, controller 150 is located within beneath the user interface panel 136 on door 126. In such an embodiment, input/output ("I/O") signals may be routed between controller 150 and various operational components of refrigerator appliance 100. In one exemplary embodiment, the user interface panel 136 may represent a general purpose I/O ("GPIO") device or functional block. In another exemplary embodiment, the user interface 136 may include input components, such as one or more of a variety of electrical, mechanical or electro-mechanical input devices including rotary dials, push buttons, and touch pads. The user interface 136 may be in communication with controller 150 via one or more signal lines or shared communication busses.

FIG. 3 is a front view of dispenser 114. FIG. 4 illustrates a cross-sectional view of dispenser 114 taken along the 4-4 line of FIG. 3. As may be seen in FIGS. 3 and 4, dispenser 114 extends between a top 175 and a bottom 176 along a vertical direction V. Dispenser 114 also extends between a front 177 (FIG. 4) and a back 178 (FIG. 4) along a transverse direction T (FIG. 4). The vertical and transverse directions V and T are perpendicular to one another.

In FIGS. 3 and 4, a container 172 is inserted within the recessed portion 138 of dispenser 114 in order to initiate a flow of water, shown as arrow F, into container 172. As an example, a user can insert container 172 into recessed portion 138 along the transverse direction T until container impacts activation member 132. The user can urge container 172 against activation member 132 until activation member 132 deflects towards the back 178 of dispenser 114 as best shown in FIG. 4. When activation member 132 is in such a configuration, controller 150 initiates the flow of water F into container 172.

The flow of water F is directed into container 172 from a water outlet 170 mounted within an ice outlet 171. Both water outlet 170 and ice outlet 171 are components of the dispensing outlet 134 described above. Ice outlet 171 can direct ice from insulated housing 142 (FIG. 2) into container 172 in the manner described above. Conversely, water outlet 170 is in fluid communication with a water supply (not shown) such that water outlet 170 may receive water from the water supply and direct such water into container 172 as flow of water F. It should be understood that the term "water supply" is used herein to encompass any manner or combination of valves, lines or tubing, housing, and the like, and may simply comprise a conventional (e.g., cold) water connection.

Dispenser 114 includes features for assisting a user in accurately and/or easily directing flow of water F into an opening 174 of container 172. In particular, dispenser 114 includes a camera 180 directed towards recessed portion 138. Camera 180 is specifically directed to a section of recessed portion 138 where opening 174 of container 172 is frequently positioned by a user. The direction of camera 180 is shown by line L.

Camera 180 is mounted within dispenser 114 above dispenser recess 138 along vertical direction V. Camera 180 is also positioned adjacent water outlet 170. However, camera 180 may be mounted at any other suitable location. For example, camera 180 may be mounted to refrigerator doors 126 and 128 or within dispenser recess 138.

Camera 180 may be any type of device suitable for capturing an image 184 (image 184 is shown presented on a display 182 in FIG. 3 as discussed in greater detail below). As an example, camera 180 may be a video camera or a digital camera with an electronic image sensor, e.g., a charge coupled device (CCD) or a CMOS sensor. Camera 180 is in communication with controller 150 such that controller 150 may receive a signal from camera 180 corresponding to image 182 captured by camera 180.

A display 182 is mounted above dispenser 114. Display 182 is in communication with controller 150 such that display 182 may receive a signal from controller 150 corresponding to image 184 captured by camera 180. As may be seen in FIG. 3, display 182 can receive the signal from controller 150 and present image 184 to a user visually. Display 182 may include, for example, a liquid crystal display panel (LCD), a plasma display panel (PDP), or any other suitable mechanism for displaying image 184, e.g., a projector.

In FIGS. 3 and 4, display 182 is mounted within control panel 136. However, display 182 may be mounted at any suitable location. For example, display 182 may be mounted to one of refrigerator doors 126 and 128 (FIG. 1).

Camera 180 and display 182 may be used to assist a user in aligning flow of water F and opening 174 of container 172 such that flow of water F is directed into opening 174. As an example, as discussed above, controller 150 can initiate flow of water F when activation member 132 is actuated by a user. When activation member 132 is actuated, e.g., by container 172, controller 150 directs camera 180 to record image 184 of recessed portion 138 along line L. As shown in FIG. 3, because container 172 is positioned along line L, camera 180 captures image 184 of opening 174 of container 172. Such image 184 is presented on display 182 to the user as shown in FIG. 3.

In particular, the user can see an opening image $\mathbf{174}_i$, a water outlet image $\mathbf{170}_i$, and a flow of water image $F_i$ within image 184. As will be understood by those skilled in the art, opening image $\mathbf{174}_i$, a water outlet image $\mathbf{170}_i$, and a flow of water image $F_i$ correspond to opening 174, a water outlet 170, and a flow of water F. Utilizing image 184, the user can adjust the position of opening 174 of container 172 within recessed portion 138 so that flow of water F is directed into opening 174. In particular, the user can align opening image $\mathbf{174}_i$ and flow of water image $F_i$ in order to also align opening 174 and a flow of water F. Utilizing such visual feedback, the user can, e.g., avoid spilling water due to inaccurate placement of opening 174 relative to flow of water F. Also, the user can avoid stooping or bending over to directly observe and align opening 174 and flow of water F.

As will be understood by those skilled in the art, in alternative exemplary embodiments, flow of water F and/or displaying image 184 taken by camera 180 on display 182 may be initiated with any suitable input. For example, refrigerator appliance 100 may include a sensor (not shown) mounted within dispenser 114 that detects container 172 entering recessed portion 138. In response to a signal from such sensor, controller 150 may initiate the flow of water F and/or display image 184 taken by camera 180 on display 182. Conversely, user control panel 136 may include a button (not shown) that a user can depress in order to signal controller 150 to initiate flow of water F and/or display image 184 taken by camera 180 on display 182.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet defining a chilled chamber for receipt of food articles;

a door mounted to said cabinet, said door configured for permitting selective access to the chilled chamber of said cabinet;

a dispenser mounted to said door, said dispenser defining a dispensing recess;

a camera directed towards the dispensing recess of said dispenser; and a display in communication with said camera such that an image of said dispenser recess from said camera is displayed on said display when a. container is inserted into said dispenser recess, the image of said dispenser recess from said camera including the container within said dispenser recess and a flow of liquid into the container.

2. The refrigerator appliance of claim 1, wherein said camera is mounted to said dispenser.

3. The refrigerator appliance of claim 1, wherein said camera is positioned above the dispenser recess of said dispenser.

4. The refrigerator appliance of claim 1, wherein said camera is positioned adjacent a water outlet of said dispenser.

5. The refrigerator appliance of claim 1, wherein said display comprises an LCD Screen.

6. The refrigerator appliance of claim 1, wherein. said display is mounted to said door.

7. The refrigerator appliance of claim 6, wherein said display is positioned above said dispenser.

8. The refrigerator appliance of claim 1, further comprising a controller in communication with said camera and said display, said controller configured for:

receiving a signal from said camera corresponding to the image of said dispenser recess; and sending a transmission to said display corresponding to the image of said dispenser recess.

9. The refrigerator appliance of claim 8, wherein said controller is configured for performing said steps receiving and sending at least in part in response to the container being inserted into said dispenser recess.

10. The refrigerator appliance of claim 8, wherein said controller is configured for performing said steps receiving and sending at least in part in response to an input on a control panel mounted to said door being activating.

11. The refrigerator appliance of claim 8, wherein said controller is configured for performing said steps receiving and sending at least in part in response to an activation member mounted within said dispenser recess being triggered.

12. A refrigerator appliance comprising:

a cabinet defining a chilled chamber configured for receipt of food items;

a door mounted to said cabinet and configured for permitting selective access to the chilled chamber of said cabinet;

a dispenser for directing a flow of ice or water into a dispenser recess defined by said dispenser, said dispenser mounted to said door;

a camera mounted to said door and pointed towards the dispenser recess of said dispenser; and a display mounted to said door, said display in communication with said camera such that an image of a container within said dispenser recess and a flow of water into the container from said camera is displayed on said display when the container is inserted into said dispenser recess.

13. The refrigerator appliance of claim 12, wherein said camera is mounted within said dispenser.

14. The refrigerator appliance of claim 12, wherein said camera is positioned above the dispenser recess of said dispenser.

15. The refrigerator appliance of claim 12, wherein said camera is positioned adjacent a water outlet of said dispenser.

16. The refrigerator appliance of claim 12, wherein said display comprises an LCD screen.

17. The refrigerator appliance of claim 12, wherein said display is mounted to said door above said dispenser.

18. A refrigerator appliance comprising:

a cabinet defining a chilled chamber for receipt of food articles;

a door mounted to said cabinet, said door configured for permitting selective access to the chilled chamber of said cabinet;

a dispenser mounted to said door, said dispenser defining a dispensing recess; and a means for assisting a user with aligning a container with an outlet of said dispenser.

19. The refrigerator appliance of claim 1, wherein said camera is directed towards an opening of the container such that the image of said dispenser recess from said camera shows the flow of liquid entering the container at the opening of the container.

20. The refrigerator appliance of claim 12, wherein said camera is directed towards an opening of the container such that the image of said dispenser recess from said camera shows the flow of liquid entering the container at the opening of the container.

* * * * *